US005499930A

United States Patent [19]

Cieri

[11] Patent Number: 5,499,930

[45] Date of Patent: Mar. 19, 1996

[54] IN-LINE DIMMER SWITCH

[75] Inventor: Mark A. Cieri, Allentown, Pa.

[73] Assignee: Lutron Electronics Co., Inc., Coopersburg, Pa.

[21] Appl. No.: 234,527

[22] Filed: Apr. 28, 1994

[51] Int. Cl.[6] ..... H01R 4/24

[52] U.S. Cl. ..... 439/417; 439/374

[58] Field of Search ..... 338/179, 198; 439/417–419, 395–404, 465, 695, 696, 701, 374

[56] References Cited

U.S. PATENT DOCUMENTS

| | | | |
|---|---|---|---|
| 2,398,996 | 4/1946 | Benander | 439/696 |
| 2,920,303 | 1/1960 | Johnson | 439/411 |
| 4,104,606 | 8/1978 | De Witt | 378/198 |
| 4,352,540 | 10/1982 | Lui | 439/696 |

*Primary Examiner*—David L. Pirlot

*Attorney, Agent, or Firm*—Seidel, Gonda, Lavorgna & Monaco

[57] ABSTRACT

A dimmer switch adapted to be connected in-line with an electrical power cord for selectively varying the power applied by the cord to an electric load, such as an electric lamp or the like. The dimmer switch includes a housing containing a dimming circuit and stab-type terminals for piercing the insulation on a power cord in order to make electrical contact between the power cord's wire conductors and-the dimming circuit. According to the invention, the dimmer switch housing is adapted to receive power cords of different sizes, e.g. SPT-1 and SPT-2, and apparatus is provided for reliably connecting the wire conductors of a received power cord to the stab terminals of the dimming circuit regardless of the power cord size.

10 Claims, 4 Drawing Sheets

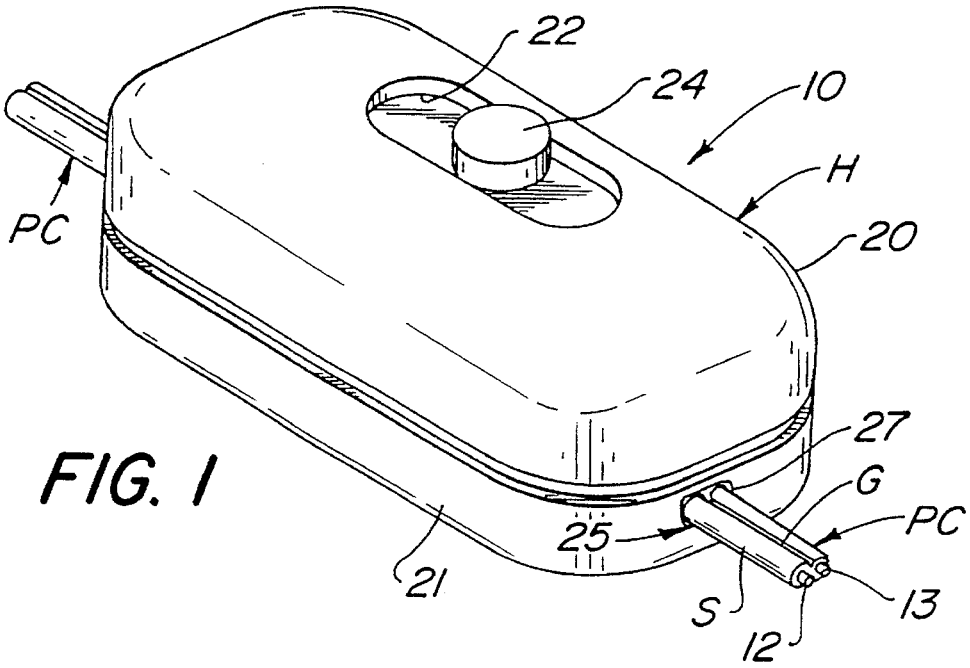
FIG. 1
FIG. 2
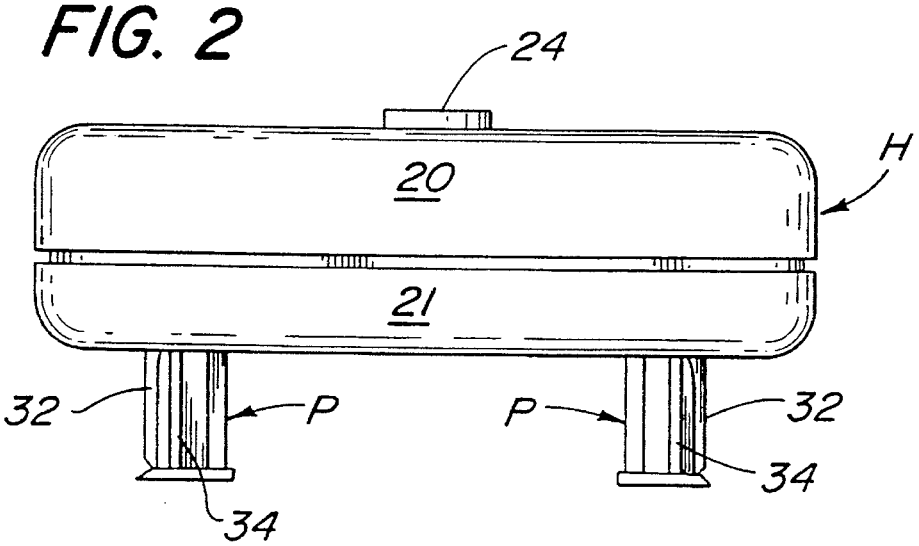
FIG. 3
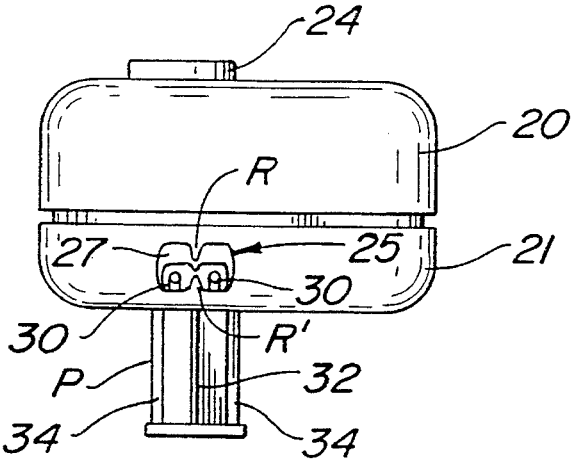

FIG. 4
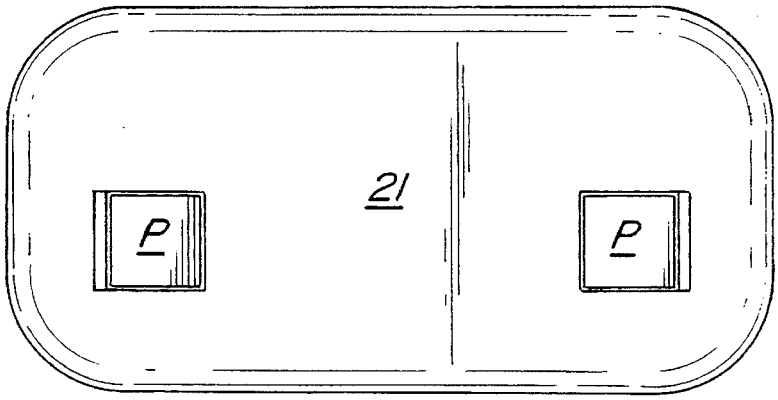
FIG. 6A
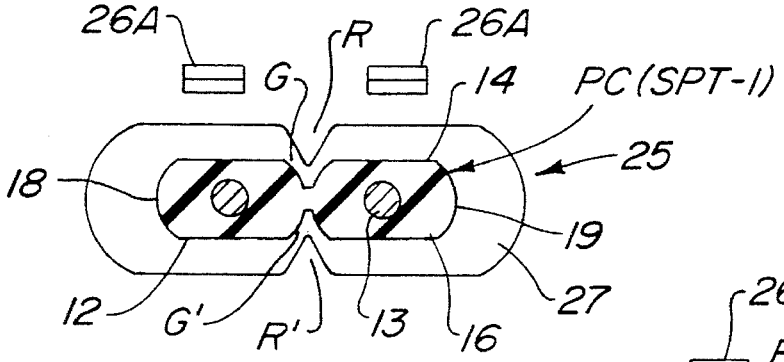
FIG. 6B
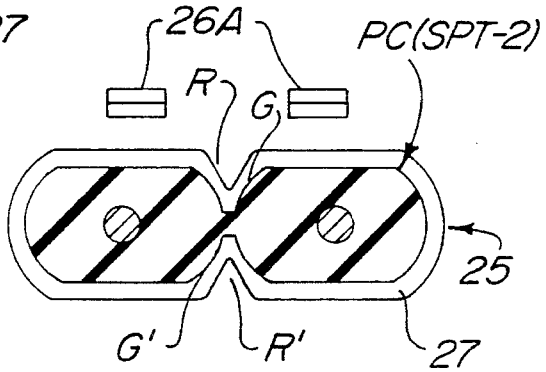
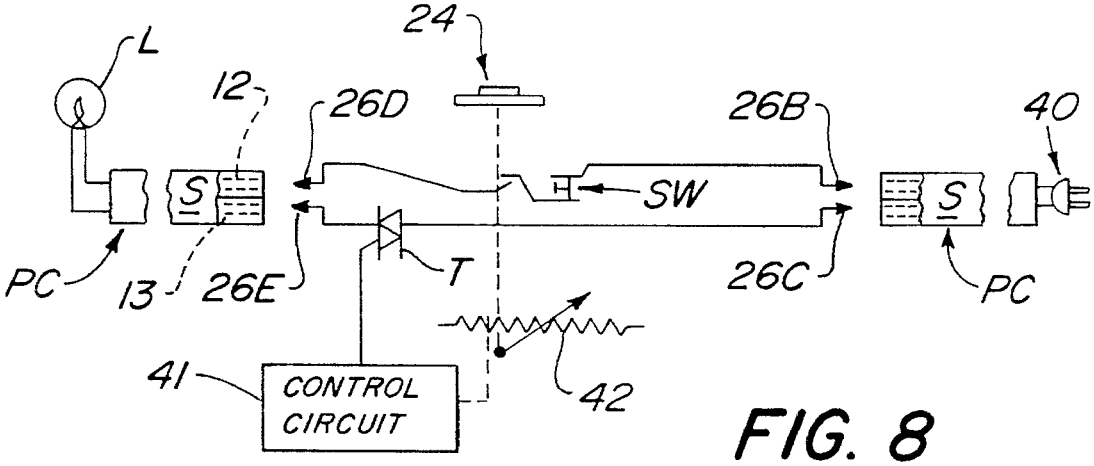
FIG. 8

IN-LINE DIMMER SWITCH

BACKGROUND OF THE INVENTION

1. Field of the Invention

The present invention relates to improvements in lamp dimmers of the type adapted to be connected in-line with a conventional power cord used to connect an electric lamp or the like to a power source.

2. Description of the Prior Art

In the commonly assigned U.S. Pat. No. 4,104,606, issued in the name of R.R. DeWitt, there is disclosed a lamp dimmer switch which is connectable in-line with a conventional power cord in order to selectively vary the power applied to an electric lamp and thereby adjust or dim the lamp's luminous output. Such dimmer switch includes a plastic (electrically insulating) housing containing a dimming circuit and a movably mounted dimming actuator which, when moved, varies the output of the dimming circuit as a function of the actuator's position. In order to connect the dimmer switch in line with the lamp's power cord, it is first necessary to sever the power cord at some point intermediate the lamp and plug. Having severed the cord, each of the two severed ends of the cord is inserted into an opening formed in the plastic housing and designed to receive a severed cord end. Upon being inserted a predetermined distance into such opening, each of the severed ends of the power cord is positioned to be acted upon by a plunger member which is also movably mounted on the dimmer housing. Movement of the plunger member in a direction perpendicular to the power cord acts to deflect the severed end of the power cord into engagement with a pair of conductive "stab" terminals, each being electrically connected to one of the input or output terminals of the dimming circuit. During movement of the plunger members, the stab terminals are designed to pierce the power cord's insulation and thereby make electrical contact with the internal conductors of the power cord.

In the dimmer switch described above, the combination of stab terminals and plungers have proven highly reliable in connecting a power cord to a dimming circuit without any need for stripping insulation from the cord, dissembling the housing to expose circuit terminals, and the other difficulties normally associated with making electrical connections to a device of this type. The reliability of the circuit connection, however, has been achieved by carefully sizing the overall dimensions of the power cord openings in the switch housing to receive a power cord of a particular width, such as the width of SPT-1 cord, and by carefully locating the stab terminals along the path of deflection taken by the power cord ends when acted upon by the plunger. If one were to attempt to connect the dimmer switch in line with a power cord of wider or narrower dimensions than that for which the switch housing was designed, one would find that the wider cord would not fit within the housing's power cord opening, and that the narrower cord would not be reliably located by the walls of the opening to achieve a reliable connection between the stab terminals and the cord conductors. Thus, to assure a reliable in-line connection, a different dimmer switch housing is required for each power cord size.

SUMMARY OF THE INVENTION

In view of the foregoing discussion, an object of this invention is to provide an improved in-line dimmer switch which is adapted for use with power cords of different sizes, particularly different widths.

The invention makes use of the fact that certain conventional power cords of different sizes have in common a pair of opposing and longitudinally extending grooves formed on opposite sides of the cord at a location midway between the cord's lateral edges. According to a preferred embodiment of the invention, each of the power cord-receiving openings of an in-line dimmer switch housing is provided with a pair of opposing centering ribs which, during insertion of a severed power cord end into the opening, engage the opposing grooves in the power cord and guide the cord along a desired path. Thus, in accordance with the invention, a power cord is guided along a desired path within the dimmer switch housing by contacting the cord's central region, rather than by contacting its lateral edges, as is done in the prior art. Accordingly, proper positioning of the power cord within the switch housing is independent of the cord width and, so long as the power cord opening is sufficient large to receive cords of different sizes, any size power cord of the type described can be accommodated and properly positioned. Preferably, each of the above-mentioned plunger members is also provided with a centering rib for guiding the power cord by its longitudinal groove during movement of the cord toward engagement with the stab terminals of the dimming circuit.

The invention and its various advantages will be better understood from the ensuing description of a preferred embodiment, reference being made to the accompanying drawings wherein like reference characters designate like parts.

BRIEF DESCRIPTION OF THE DRAWINGS

FIG. 1 is a perspective view of a dimmer switch embodying the invention;

FIGS. 2–4 are side, end and bottom elevational views, respectively, of the FIG. 1 apparatus;

FIGS. 6A and 6B illustrate the manner in which power cords of different sizes are received by the FIG. 1 apparatus;

FIG. 8 is an electrical schematic of the basic circuit components of the in-line dimmer switch of the present invention.

DETAILED DESCRIPTION OF A PREFERRED EMBODIMENT

Figure 5:
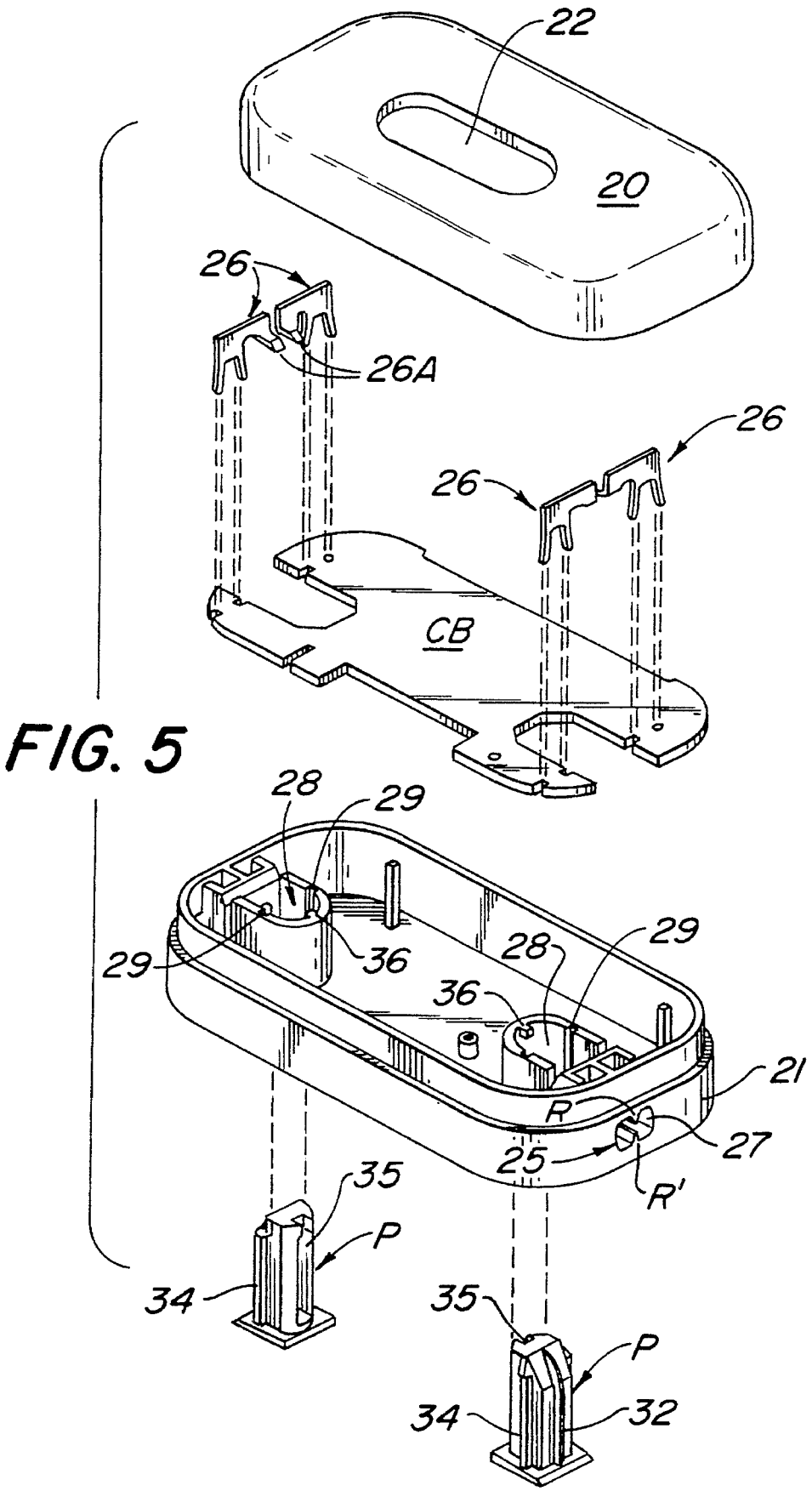
FIG. 5 is an exploded view of the FIG. 1 apparatus showing certain internal components thereof.

As indicated above, the invention described below represents an improvement over the in-line dimmer switch disclosed in the commonly assigned U.S. Pat. No. 4,104,606. Thus, the disclosure of this patent is incorporated herein by reference.

Referring now to the drawings, FIG. 1 illustrates a dimmer switch 10 connected in-line with a lamp power cord PC. The power cord is of conventional design, comprising a pair of wire conductors 12, 13 covered by an electrically insulating sheath S. As shown in the cross-sectional illustrations of FIGS. 6A and 6B, the insulating sheath of a conventional lamp power cord may be considered as having a generally rectangular configuration, having generally flat opposing surfaces, 14, 16, connected by relatively short and arcuate side walls 18, 19. An important characteristic of such power cords, at least from the standpoint of this invention, is that their upper and lower surfaces 14, 16 define opposing longitudinal grooves G,G' which extend the entire length of the cord. These grooves are located midway between the cord's lateral edges and result from a manufacturing process in which two individual conductors, each having its own sheath of insulating material, are joined together along a common lateral side. As will be seen below, the apparatus of the invention makes good use of these longitudinal grooves in precisely guiding and positioning a power cord within the dimmer switch housing for the purpose of reliably connecting the power cord's conductors to the lamp-dimming circuitry within the housing.

Referring to FIGS. 1–5, dimmer switch 10 comprises a housing H which encloses a conventional lamp dimming circuit which operates to selectively control the electrical power applied to a lighting load for the purpose of adjusting the load's luminous output. Such a circuit is generally shown in FIG. 8 and discussed below. Housing H is made of an insulating material, preferably plastic, and comprises concave top and bottom portions 20,21, respectively, which snap together to define a hollow enclosure. An elongated aperture 22 is provided in the top housing portion 20, and a manually manipulatable dimmer actuator 24 protrudes through aperture 22. The dimmer actuator is slidably mounted within aperture 22, and the position of the actuator determines the voltage applied to the lighting load. The bottom portion 21 of housing H is provided with a pair of openings 25 at opposite ends thereof for receiving the severed ends of a lamp cord that are to be connected to the conductive stab terminals 26 (shown in FIG. 5) of the internal dimming circuit. Housing openings 25 communicate with a passageway 27 within the housing which accepts a predetermined length of power cord. A pair of plunger members P are slidably mounted in channels 28 formed in the bottom portion of the switch housing, such channels communicating with and extending in a direction substantially perpendicular to passageways 27. Plungers P function, as described below, to deflect a severed end of power cord positioned in passageways 27 toward engagement with the stab terminals 26 which eventually penetrate the power cord sheath and thereby make electrical connection between the power cord conductors and the dimming circuit. The stab terminals are supported by a circuit board CB which also functions to support the dimming circuitry.

Figure 7A:
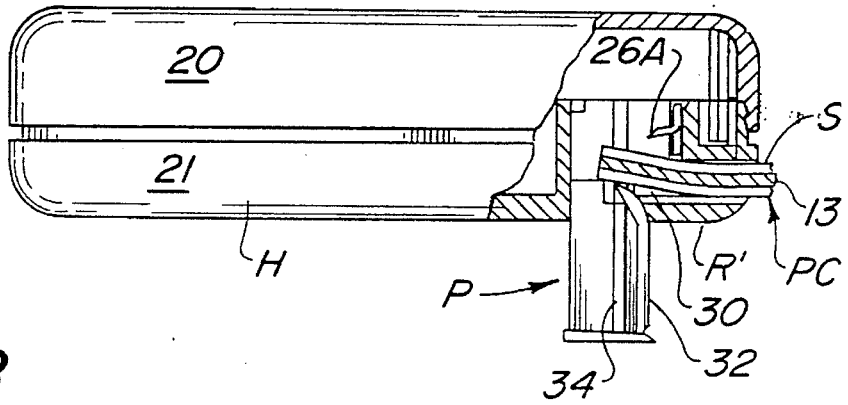
FIGS. 7A–7D are partial cross-sectional views of the FIG. 1 apparatus showing the manner in which a power cord is deflected to make electrical contact with the terminals of a dimming circuit.
Figure 7B:
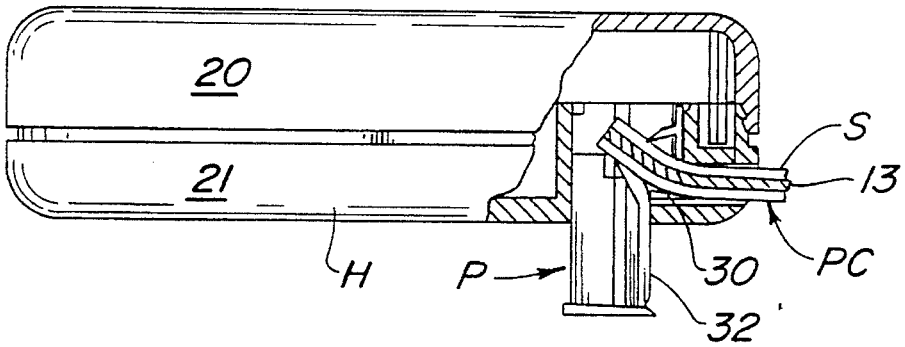
Figure 7C:
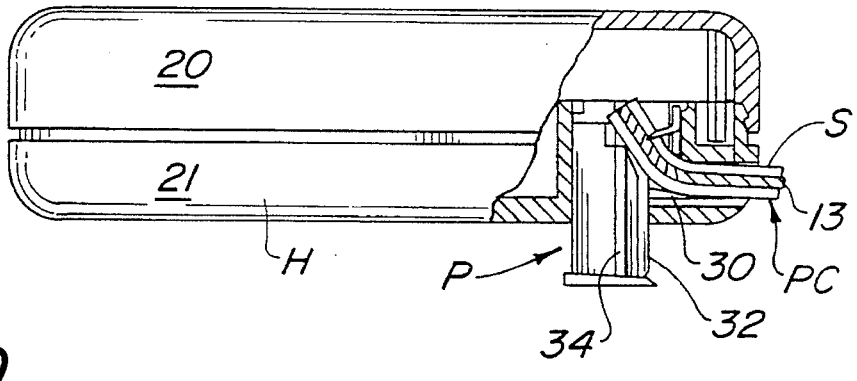
Figure 7D:
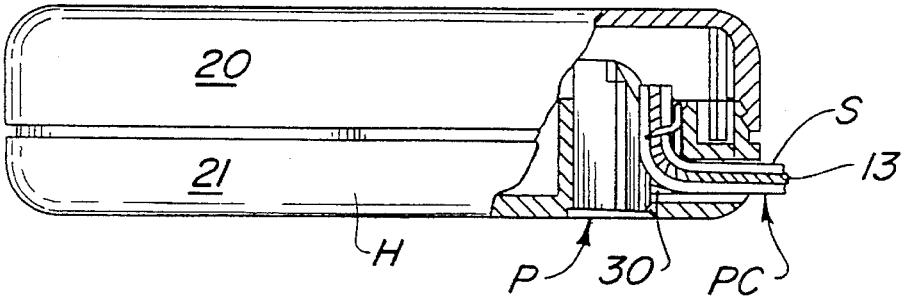

According to the present invention, passageway 27 is sufficiently large to receive power cords of different sizes and, to assure that a received cord is properly located within the passageway 27 regardless of size, the top and bottom walls of such passageway are shaped to define a pair of opposing centering ribs R,R'. During the insertion of a severed end of power cord into one or the other of openings 25, the centering ribs engage the opposing grooves G,G' on the power cord and act to direct the cord along a predetermined path within the passageway. Preferably, the bottom wall of the passageways also defines a pair of ramps 30 which act to deflect the leading edge of a severed cord in an upward direction (toward the interior of the housing) to facilitate further deflect of the cord by the plunger members. Preferably, each of the plungers is also provided with a cord-centering rib 32 which engages the cord groove G' during movement of the plunger from its retracted position, shown in FIG. 7A, towards its fully seated position, shown in FIG. 7D. The plungers are also preferably provided with lateral ribs 34 which engage guide grooves 29 formed in the side walls of channels 28 and serve to prevent the plunger from rotating during its insertion into the housing. Also, each channel 35 is provided with a stop 36 which is engagable with the leading edge of a severed cord end to prevent the insertion of the cord end into the circuit-containing portion of the housing. Each plunger is provided with a longitudinally extending clearance groove 35 which allows the plunger to move in channel 28 unimpeded by the stop member 36. The cord-centering ribs R,R' and 32 assure that the cord is properly located relative to the stab terminals 26 so that, regardless of cord size, the stab terminals make contact with the cord conductors. Preferably, each of the stab terminals comprises a knife edge 26A that is oriented normal to the direction in which the cord extends at the time the stab terminals engage the cord conductors. These knife edges are sufficiently wide to assure contact with the wire conductors of power cords of different sizes.

Referring to FIGS. 6A and 6B, the cord-receiving opening 25 of housing H is shown as having two different sized power cords positioned therein. It will be noted that, in both cases, the lateral position of the cord within the opening is determined by the centering ribs R,R'. It is the lateral position of the cord, of course, that determines the cord location relative to the stab terminals 26. Lamp power cords of the above type are generally available in two different sizes, commonly referred to as SPT-1 and SPT-2. While the diameter of the wire conductors are the same for both cords, both usually comprising a No. 18 gauge twisted copper wire, the thickness of the insulation on the SPT-1 cord is considerably smaller than that of the the SPT-2 cord. This results in the SPT-1 cord having an overall width of about 5.3 mm., compared to about 6.8 mm. for the SPT-2 cord, and a thickness of about 2.8 mm., compared to a 3.4 mm thickness for the SPT-2 cord. Also, the spacing between the wire conductors of the SPT-1 cord is narrower than the spacing between the conductors of the SPT-2 cord. As noted above, the width of the knife edge of the stab terminals is dimensioned to accommodate this difference in spacing.

The process by which a severed end of a power cord is electrically connected with the terminals of a dimming circuit is best shown in FIGS. 7A through 7D. Initially, the plunger member P is manually retracted from the housing to the position shown in FIG. 7A. The cord end is then inserted into housing opening 25 until the leading edge is raised by ramps 30 and the cord end stops against the side wall of channel 28. Plunger P is then depressed and, as it moves into the housing through the positions shown in FIGS. 7B–7D, centering rib 32 engages groove G' and guides the power cord end into engagement with the stab terminals 26. It will be appreciated that as the plunger continues its inward movement, an increasingly larger portion of rib 32 engages the cord groove, thereby increasing the precision by which the cord is located relative to the stab terminals. Owing to the engagement between the plungers lateral ribs 34 and the channel guide grooves 29, the plunger's centering rib is always located midway between the stab terminals. When the plunger reaches the position shown in FIG. 7D, the stab terminal fully pierces the cord insulation and electrically contacts the cord conductor.

FIG. 8 shematically illustrates a dimming switch circuit connected in-line with a power cord having one end connected to a light source L and the other end connected to a standard plug 40 adapted to be connected to a line voltage source. The circuit includes a controllably-conductive device, shown as a triac T, which operates under control of a control circuit 41 to block a predetermined portion of an A.C. waveform applied to the lighting load in order to vary the RMS voltage applied to the load. Movement of dimmer actuator 24 acts to both open and close an air-gap switch SW, as well as to vary the resistance provided by a potentiometer 42 used to control the output of the control circuit. In the circuit shown in FIG. 8, the device is shown as having separate terminals 26B–26C and 26D–26E for connection in series with a severed line. This circuit can be modified, wherein the structure provides only a single set of stab terminals 26B–26C while the stab terminals 26D and 26E are directly connected to one another by a short length of wire. The internal structure of the switch and dimmer device, however, can be identical to that previously described. Such a modified circuit can then be used with a special split plug power cord of the type described in the afore-referenced patent so that the device can be used as a table top dimmer and/or switch device. In this case, housing H need only receive one end of a power cord.

While the invention has been described with particular reference to an in-line dimmer switch, it will be appreciated that the specifics of the circuitry are only incidental to the invention; in fact, the circuitry need not necessarily provide a dimming and/or switching function. For example, the above-described mechanism for aligning power cords of different sizes and connecting their respective conductors to stab terminals and the like could be used in power cord plugs and plug-receptacles where it is desired to connect the power cord conductors to the electrical terminals of such devices without stripping the insulation from the power cord. The respective housings of such plugs and receptacles could be modified to include the above-described cord-guiding apparatus.

Although preferred embodiments of this invention have been described, many variations and modifications will now be apparent to those skilled in the art, and it is therefore preferred that the instant invention be limited not by the specific disclosure herein but only by the appended claims.

What is claimed is:

1. A lamp dimmer switch adapted to be connected in-line with a lamp power cord of the type comprising a pair of electrical conductors covered by an insulating sheath, such sheath having a surface defining a pair of opposing grooves extending along the length of the power cord, said dimmer switch comprising:

a housing for enclosing said dimmer switch, said housing defining an internal passageway which communicates with the exterior of said housing through an opening, said passageway being adapted to receive a severed end of the power cord inserted therein through said opening, said passageway comprising wall means defining a pair of spaced, opposing and parallel ribs for engaging the opposing grooves of a received power cord and for guiding said power cord along a predetermined path within said passageway;

a dimming circuit disposed within said housing, said dimming circuit having a plurality of spaced, electrically conductive stab terminals adapted to be connected to said electrical conductors; and means located along said predetermined path for urging a received and guided power cord into engagement with said stab terminals, whereby said stab terminals pierce said sheath and make electrical contact with said conductors.

2. The apparatus as defined by claim 1 wherein said stab terminal comprises a knife-edge conductor arranged perpendicular to said predetermined path.

3. The apparatus as defined by claim 1 wherein said urging means comprises a plunger member movably mounted on said housing, said plunger member being movable in a direction substantially perpendicular to said predetermined path, whereby a severed power cord end located in said passageway is deflected out of said passageway, said plunger member including guide means for guiding the deflection of said severed power cord end along a second predetermined path toward engagement with said stab terminals.

4. The apparatus as defined by claim 3 wherein said guide means comprises an elongated rib on said plunger member, said rib being adapted to engage the elongated groove in the sheath of said severed power cord end during the deflection thereof.

5. A switch adapted to be connected in-line with a power cord of the type comprising a pair of electrical conductors covered by an insulating material, said power cord having a generally flattened configuration comprising spaced top and bottom surfaces interconnected by shorter side surfaces, said switch comprising:

a housing for enclosing said switch, said housing defining an internal passageway which communicates with the exterior of said housing through an opening, said passageway being adapted to receive a severed end of a power cord inserted therein through said opening, said passageway comprising means for guiding said power cord along a predetermined path within said passageway by contacting said power cord only along its top and bottom surfaces at a location intermediate said side surfaces, whereby the power cord is guided without regard for its width;

a switch disposed within said housing, said switch having a plurality of spaced, electrically conductive terminals adapted to be connected to said electrical conductors, and means located along said predetermined path for urging a received and guided power cord into engagement with said terminals.

6. The apparatus as defined by claim 5 wherein said urging means comprises a plunger member movably mounted on said housing, said plunger member being movable in a direction substantially perpendicular to said predetermined path, whereby a severed power cord end located in said passageway is deflected out of said passageway, said plunger member including guide means for guiding the deflection of said severed power cord end along a second predetermined path toward said terminals.

7. The apparatus as defined by claim 6 wherein said plunger member is provided with means for preventing rotation about an axis parallel to the direction in which it is movable.

8. A device adapted to be connected to a power cord of the type comprising a pair of electrical conductors covered by an insulating material, said power cord having a generally flattened configuration comprising spaced top and bottom surfaces interconnected by shorter side surfaces, said advice comprising:

a housing defining an internal passageway which communicates with the exterior of said housing through an opening, said passageway being adapted to receive a severed end of a power cord inserted therein through said opening, said passageway comprising means for guiding said power cord along a predetermined path within said passageway by contacting said power cord only along its top and bottom surfaces at a location intermediate said side surfaces, whereby the power cord is guided without regard for its width;

an electrical circuit disposed within said housing, said circuit having a plurality of spaced, electrically conductive terminals adapted to be connected to said electrical conductors, and means located along said predetermined path for urging a received and guided power cord into engagement with said terminals.

9. The apparatus as defined by claim 8 wherein said urging means comprises a plunger member movably mounted on said housing, said plunger member being movable in a direction substantially perpendicular to said predetermined path, whereby a severed power cord end located in said passageway is deflected out of said passageway, said plunger member including guide means for guiding the deflection of said severed power cord end along a second predetermined path toward said terminals.

10. The apparatus as defined by claim 9 wherein said plunger member is provided with means for preventing rotation about an axis parallel to the direction in which it is movable.

* * * * *